US011623422B2

(12) United States Patent
Altamirano Paez

(10) Patent No.: US 11,623,422 B2
(45) Date of Patent: Apr. 11, 2023

(54) CONTAINER FORMING MACHINE HAVING A BLANK STACKER ASSEMBLY

(71) Applicant: DART CONTAINER CORPORATION, Mason, MI (US)

(72) Inventor: Luis Enrique Altamirano Paez, Palos Hills, IL (US)

(73) Assignee: Dart Container Corporation, Mason, MI (US)

( * ) Notice: Subject to any disclaimer, the term of this patent is extended or adjusted under 35 U.S.C. 154(b) by 62 days.

(21) Appl. No.: 17/130,440

(22) Filed: Dec. 22, 2020

(65) Prior Publication Data

US 2022/0194042 A1 Jun. 23, 2022

(51) Int. Cl.

| | |
|---|---|
| ***B31B 50/00*** | (2017.01) |
| ***B31B 50/04*** | (2017.01) |
| ***B31B 50/02*** | (2017.01) |
| ***B31B 50/06*** | (2017.01) |

(52) U.S. Cl.

CPC ..... *B31B 50/006* (2017.08); *B31B 50/022* (2017.08); *B31B 50/04* (2017.08); *B31B 50/06* (2017.08)

(58) Field of Classification Search

CPC ..... B31B 50/006; B31B 50/04; B31B 50/02; B31B 50/022; B31B 50/024; B31B 50/046; B31B 50/06; B31B 50/062; B31B 50/066; B31B 50/07; B31B 2105/0022; B31B 2110/10; B65H 31/00

See application file for complete search history.

(56) References Cited

U.S. PATENT DOCUMENTS

| | | | | |
|---|---|---|---|---|
| 1,743,424 | A | 1/1930 | Carle | |
| 1,786,476 | A | 12/1930 | Carle | |
| 1,786,477 | A | 12/1930 | Carle | |
| 2,598,150 | A * | 5/1952 | Wethe | B31B 50/062 271/14 |
| 2,624,248 | A * | 1/1953 | Baker | B31B 50/00 493/167 |
| 3,008,385 | A * | 11/1961 | Pierce, Jr. | B31B 50/44 493/137 |
| 3,054,144 | A | 9/1962 | Goodwin et al. | |
| 3,065,679 | A * | 11/1962 | Clement | B31B 50/00 493/171 |
| 3,364,825 | A | 1/1968 | Baumgartner | |

(Continued)

FOREIGN PATENT DOCUMENTS

| | | | |
|---|---|---|---|
| GB | 516097 | A | 12/1939 |
| GB | 546489 | A | 7/1942 |

(Continued)

*Primary Examiner* — Thomas M Wittenschlaeger
(74) *Attorney, Agent, or Firm* — McGarry Bair PC

(57) ABSTRACT

A paperboard blank stacker assembly for supplying a stack of paperboard blanks to a container forming machine includes a stacker. The stacker has multiple blank stops arranged to hold a peripheral edge of a bottom blank of the stack of paperboard blanks, with the multiple blank stops defining an interior region. A blank carrier has at least one suction device moveable into a grasp position, where the suction device applies a suction force to the bottom blank, and a removal position, where the suction device is moved to remove the bottom blank from the stack of paperboard blanks by pulling the bottom blank through the interior region.

19 Claims, 8 Drawing Sheets

(56) References Cited

U.S. PATENT DOCUMENTS

| | | | | | |
|---|---|---|---|---|---|
| 3,537,361 | A | * | 11/1970 | Bridger | B31B 50/802 493/30 |
| 3,753,333 | A | * | 8/1973 | Derderian | B31B 50/80 53/381.1 |
| 3,815,483 | A | * | 6/1974 | Cato | B31B 50/022 493/123 |
| 4,917,663 | A | * | 4/1990 | Pazdernik | B31B 50/00 493/317 |
| 5,415,615 | A | * | 5/1995 | Culpepper | B31B 50/024 53/566 |
| 5,456,570 | A | * | 10/1995 | Davis, Jr. | B31B 50/024 414/742 |
| 8,448,588 | B1 | * | 5/2013 | Lindley | D05B 47/06 112/254 |
| 8,828,170 | B2 | | 9/2014 | Stamatiou et al. | |
| 9,676,141 | B2 | | 6/2017 | Stamatiou et al. | |

FOREIGN PATENT DOCUMENTS

| | | | |
|---|---|---|---|
| GB | 580857 | A | 9/1946 |
| GB | 658786 | A | 10/1951 |
| GB | 772291 | A | 4/1957 |
| KR | 100746596 | B1 | 8/2007 |

* cited by examiner

CONTAINER FORMING MACHINE HAVING A BLANK STACKER ASSEMBLY

BACKGROUND

Conventional two-piece paperboard containers are generally made by cutting sleeve blanks from a paperboard web, wrapping the sleeve blank around a forming mandrel, and securing the wrapped sleeve blank at a sidewall seam to form a sleeve that is sealed with a bottom blank for forming the two-piece container. The sleeve blank and the bottom blank can be assembled by a container forming machine to form the container defining a cavity for holding material to take advantage of the high container forming rates available with current container forming machines. Such container forming machines can include an infeed assembly for the sleeve blanks, a blank stacker assembly for stacking the sleeve blanks provided from the infeed assembly, a blank carrier for removing the sleeve blanks from the blank stacker assembly, and a container forming assembly to form the sleeve blank into the container.

The sleeve blanks can be cut from the paperboard web prior to providing the sleeve blanks to the container forming machine. In some cases, the paperboard web can be stored as a roll prior to the cutting the sleeve blanks from the paperboard web. This can result in at least some of the sleeve blanks that are cut from a previously rolled paperboard web having a slightly curved profile, such that at least some of the edges of the sleeve blanks may be disposed to roll or curl inwardly, rather than the sleeve blank being flat. Further, the sleeve blanks cut from a portion of the paperboard web at an interior of the roll may be more curled or curved, while the sleeve blanks cut from a portion of the paperboard web at an exterior of the roll may be less curved, or even substantially flat. This provides an additional challenge in the manufacturing of the containers as the container forming machine needs to accommodate both flat blanks and curled blanks in the container forming process.

BRIEF DESCRIPTION

An aspect of the present disclosure relates to a paperboard blank stacker assembly for supplying a stack of paperboard blanks to a container forming machine, the assembly comprising a stacker having multiple blank stops arranged to hold a peripheral edge of a bottom blank of the stack of paperboard blanks, with the multiple blank stops defining an interior region, and a blank carrier having at least one suction device moveable into a grasp position, where the suction device applies a suction force to the bottom blank, and a removal position, where the suction device is moved to remove the bottom blank from the stack of paperboard blanks by pulling the bottom blank through the interior region, wherein at least one of the blank stops comprises a biased blank stop having a biased element applying a biasing force to a portion of the peripheral edge of the bottom blank, and the biased element is moved against the biasing force when the bottom blank is moved in response to the suction device moving from the grasp position to the removal position.

DETAILED DESCRIPTION

Aspects of the present disclosure relate to processes and apparatus for forming a two-piece paperboard container made by wrapping a paperboard sleeve blank around a paperboard bottom blank that can take advantage of the high container forming rates available with current container forming machines. Conventional two-piece paperboard containers are made by cutting a sleeve blank and a bottom blank from suitable paperboard substrates, such as paper stock that may or may not include various coatings (also referred to as a paper web). The sleeve blank and bottom blank are assembled by a container forming machine to form the container defining a cavity for holding material. The container forming machine generally includes a mandrel about which the sleeve blank is wrapped and overlapping side edges of the sleeve blank are adhered together to form a sleeve. A bottom edge of the sleeve is adhered to the bottom blank to seal the sleeve with the bottom blank and thus form the container. While aspects of the present disclosure are discussed in the context of a two-piece cup, additional container types, such as bowls and storage containers, including those suitable for use in food service, are also contemplated. It will also be understood that the aspects of the present disclosure are not limited to use with a two-piece cup or container, but can instead be applicable to cups or containers formed from any suitable number of pieces or blanks, including a single-piece cup or container. Further, while aspects of the present disclosure are discussed in the context of a paperboard container, containers made of materials other than paperboard are also contemplated, such as, by way of non-limiting example, foamed materials, plastics, or other polymers.

Figure 1:
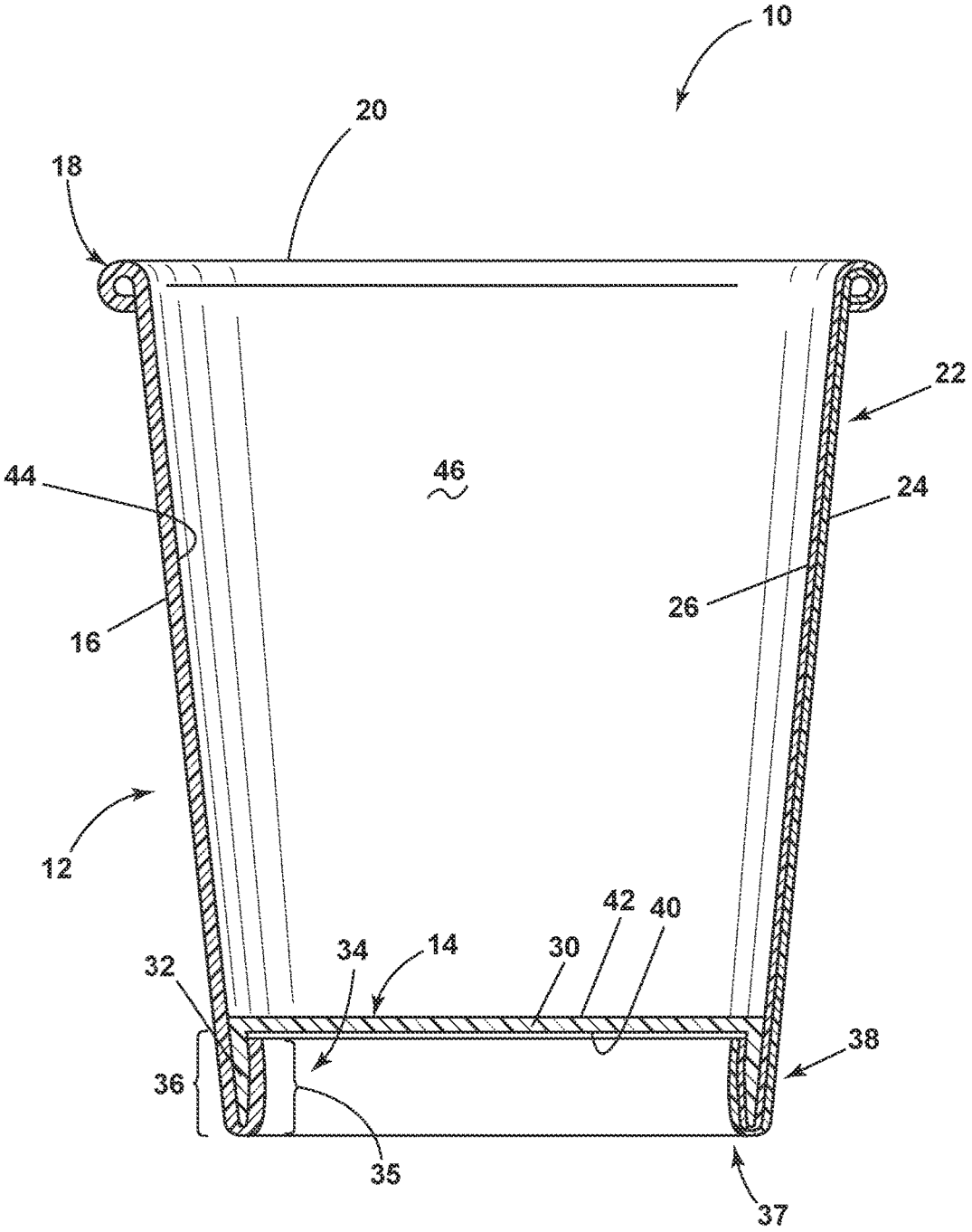
FIG. 1 is a cross-sectional view of an example of a container formed from a sleeve blank and a bottom blank.

FIG. 1 illustrates an exemplary container 10 according to an aspect of the present disclosure in the form of a cup. While aspects of the present disclosure are discussed in the context of the cup, the container 10 can have any desired shape and size and can optionally be suitable for food service. Container 10 can be in the form of a two-piece cup that includes a sleeve 12 and a bottom 14. The sleeve 12 includes a portion defining a sidewall 16 of the container 10. A rim 18 defines an open end 20 of the sleeve 12 at an upper end of the sleeve 12. The rim 18 may optionally be rolled, bent, curled, or crimped in a conventional manner. A sidewall seam 22 is formed where overlapping side edges 24, 26 of the sleeve 12 are adhered together to form the sidewall seam 22, also referred to as a sidewall seal.

A bottom portion of the sleeve 12, opposite the rim 18, is sealed with the bottom 14 by an adhesive. The bottom 14 includes a bottom wall 30 and a depending skirt 32. The sleeve 12 includes a portion defining a flange 34 that is wrapped around the skirt 32 of the bottom 14 such that the skirt 32 is sandwiched between an inner flange portion 35 and an outer flange portion 36. The wrapped skirt 32 defines a foot 37, opposite the rim 18, which supports the container 10 on a surface. An adhesive forms a seal between the flange 34 on both sides of the skirt 32 to form a bottom seal 38 between the sleeve 12 and the bottom 14.

The bottom wall 30 includes an outer surface 40 facing the foot 37 and an opposing inner surface 42. The inner surface 42 of the bottom wall 30 together with an inner surface 44 of the sidewall 16, above the bottom wall 30, together define a container cavity 46. The inner surfaces 42 and 44 define the surfaces of the container 10 that are exposed within the container cavity 46 and may come into contact with material contained within the container cavity 46.

Optionally, the container 10 can be a flat-bottom type container, rather than the illustrated raised bottom (also referred to as a pot-type container), in which the bottom 14 does not include a skirt and the flange 34 is wrapped and sealed under the bottom wall 30. The flat-bottom type container can have a bottom wall that is generally flat or has a curved portion.

Figure 2:
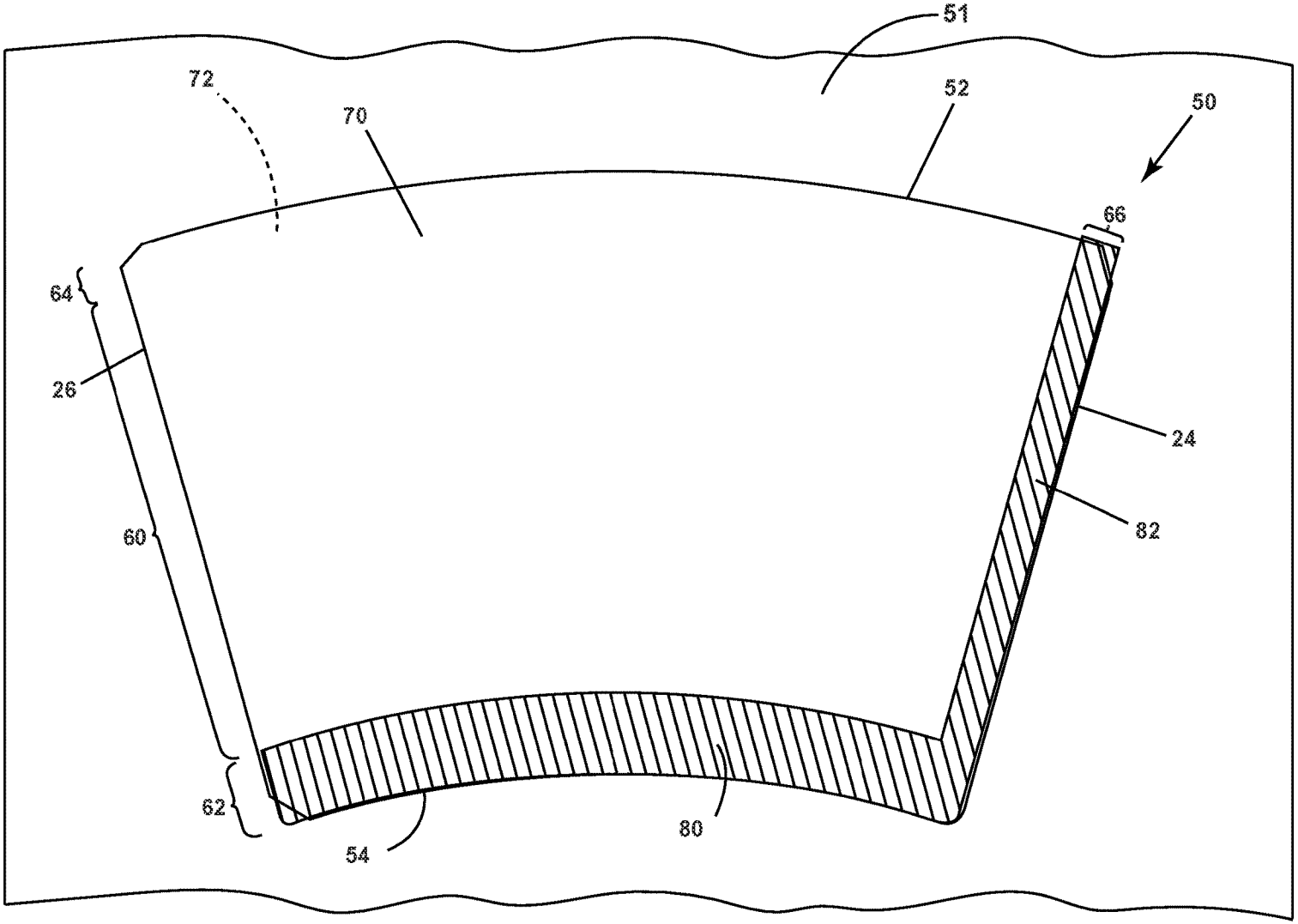
FIG. 2 is a top view of the sleeve blank of FIG. 1.

Referring now to FIG. 2, the sleeve 12 is formed from a sleeve blank 50 that can be cut from a sheet or web of paperboard stock 51. The sleeve blank 50 includes the opposing first and second side edges 24 and 26, a top edge 52 extending between the side edges 24 and 26 at an upper portion of the sleeve blank 50, and a bottom edge 54 extending between the side edges 24 and 26 at a lower portion of the sleeve blank 50, opposite the top edge 52. In one example, at least the top edge 52 and the bottom edge 54 can have an arcuate shape or profile, with the top edge 52 being the longer of the arcuate edges 52, 54 of the sleeve blank 50.

The sleeve blank 50 can be considered as having multiple portions that each form a different portion of the assembled container 10. The sleeve blank 50 includes a cavity portion 60 that corresponds to the inner surface 44 of the sidewall 16 that defines the cavity 46 of the container 10, a bottom portion 62 corresponding to the portion that defines the flange 34 that wraps around the skirt 32, and a top portion 64 corresponding to the rim 18. The sleeve blank 50 also includes a seam portion 66 that extends along at least a portion of the side edge 24 between the top and bottom edges 52 and 54. The relative dimensions of the cavity portion 60, the bottom portion 62, the top portion 64, and the seam portion 66 can vary based on the dimensions and structure of the container 10 that is to be formed. The cavity portion 60 can be defined as extending between the bottom portion 62, the top portion 64, and the seam portion 66.

The sleeve blank 50 also includes a first surface 70 and an opposing second surface 72. The sleeve blank 50 can be wrapped to form the sleeve 12 such that the first surface 70 forms an interior surface which faces a central axis of the formed container 10 and the opposing second surface 72 forms an exterior surface which faces outward, away from the central axis of the formed container 10. Optionally, the sleeve blank 50 can be wrapped to form the sleeve 12 such that the first surface 70 forms the exterior surface and the second surface 72 forms the interior surface.

In one example, the sleeve blank 50 includes a first adhesive applied to the bottom portion 62 corresponding to the flange 34 to form an adhesive bottom flange portion 80 and a second adhesive applied to the seam portion 66 to form an adhesive seam portion 82. The adhesive bottom flange portion 80 is configured to adhesively seal to the skirt 32 in the formed container 10 to form the bottom seal 38 between the sleeve 12 and the bottom 14. The adhesive seam portion 82 is configured to adhesively seal the overlapping side edges 24, 26 to form the sidewall seam 22. Optionally, when the container 10 is in the form of a flat-bottom type cup which does not include a skirt 32, the adhesive bottom flange portion 80 is configured to adhesively seal to the bottom wall 30.

In one non-limiting example, the sleeve blank 50 can be made from a solid bleached sulfate (SBS) paperboard paper stock or other paper stock suitable for forming containers 10. An example of a suitable paperboard stock is the TruServ™ brand of cupstock grades, available from WestRock, U.S.A.

The paperboard web 51 can have a width such that a single column of sleeve blanks 50 is formed in the paperboard web 51, as shown. Alternatively, the paperboard web 51 can have a width such that multiple, side-by-side columns of sleeve blanks 50 are formed in the paperboard web 51. In one non-limiting example, the paperboard web 51 can be provided or stored in a roll prior to the cutting of the sleeve blanks 50. In such an example, the roll of the paperboard web 51 is unwound prior to cutting out the sleeve blanks 50 from the paperboard web 51. The unwound paperboard web 51 can be passed through a blank cutting station (not shown), such as a blank cutter, to cut the sleeve blanks 50 from the paperboard web 51. The pre-cut sleeve blanks 50 can then be stored for later use by a container forming machine to form the container 10.

When the paperboard web 51 is rolled prior to cutting out the sleeve blanks 50, at least some of the resulting sleeve blanks 50 can be at least somewhat curved or curled, rather than lying flat, due to the bending of the paperboard web 51 to form the roll. By way of non-limiting example, at least one of the side edges 24, 26, the top edge 52, and the bottom edge 54 can have a tendency to curve or curl inwardly toward the center of the sleeve blank 50. For example, depending on the orientation at which the sleeve blanks 50 are cut from the paperboard web 51 relative to the direction in which the paperboard web 51 was rolled, the side edges 24, 26 can curl toward one another, the top edge 52 and the bottom edge 54 can curl toward one another, or only a single edge 24, 26, 52, 54 of the sleeve blank 50 may curl inwardly.

Various coatings, adhesives, sealants, inks, printed substrates, and the like can be applied to the sleeve blanks 50 prior to forming the container 10, which can occur either on the paperboard web 51, prior to cutting the sleeve blanks 50 from the paperboard web 51, or on the sleeve blanks 50 after having been cut from the paperboard web 51, or a combination of both.

Figure 3:
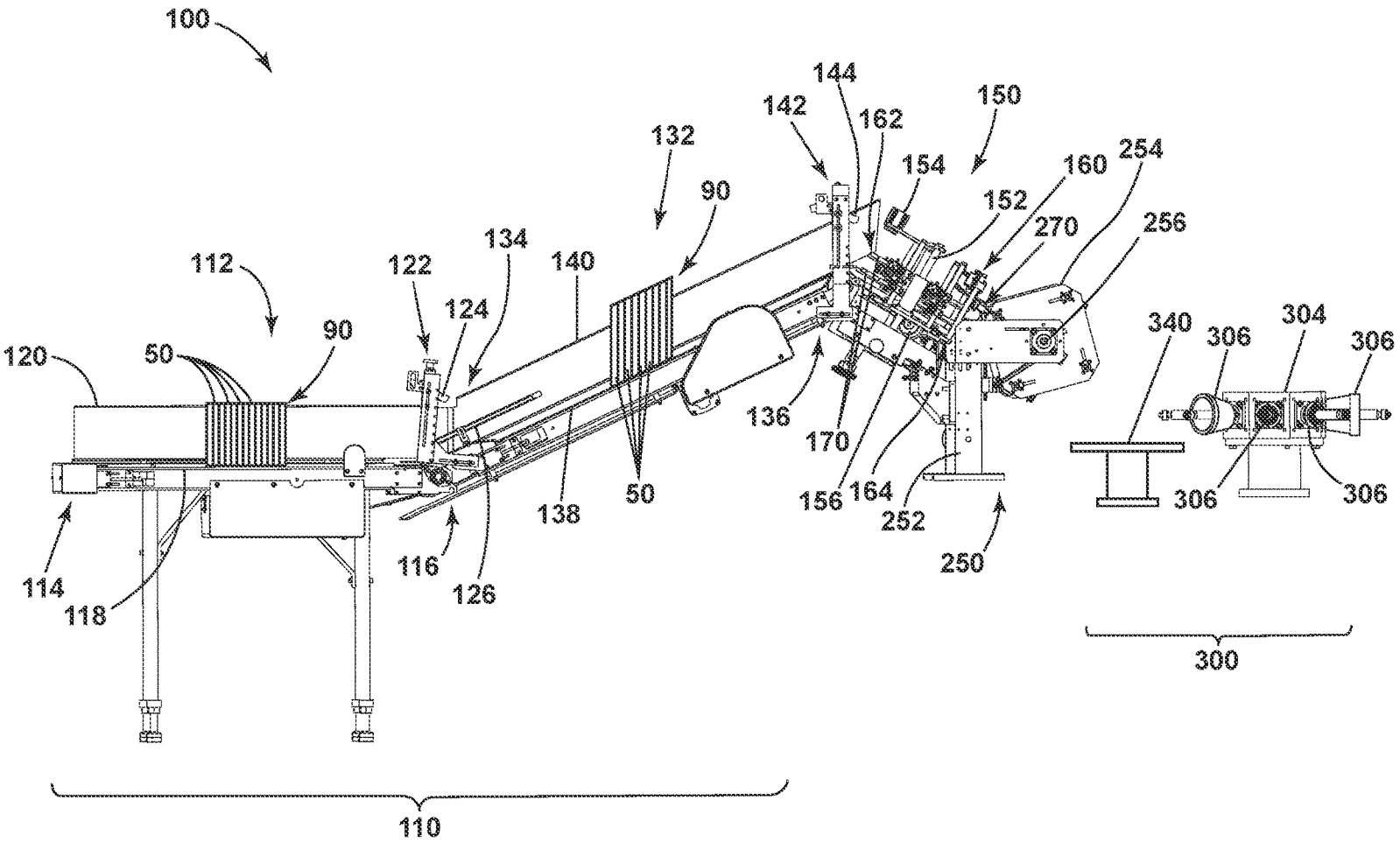
FIG. 3 is a side view of a container forming machine for use in forming the container of FIG. 1 and including an infeed assembly, a blank stacker assembly, a blank carrier, and a container forming assembly.

FIGS. 3-8 illustrate various aspects of a container forming machine 100 that can be used to form the container 10 from the sleeve blank 50. The container forming machine 100 comprises an infeed assembly 110, a paperboard blank stacker assembly 150, a blank carrier 250, and a container forming assembly 300. Referring now to FIG. 3, the sleeve blanks 50 can be provided to the container forming machine 100 as a stack 90 of abutting sleeve blanks 50, such as by an operator or by another automation assembly. While the stack 90 is shown as including several sleeve blanks 50 stacked together and abutting one another to form the stack 90, it will be understood that the container forming machine 100 can be configured for continuous infeed of sleeve blanks 50, such that a single stack 90 of sleeve blanks 50 can be continuously fed into the container forming machine 100, the single stack 90 extending continuously along the full length of the infeed assembly 110 at any given point in time during the operation of the container forming machine 100.

The infeed assembly 110 can include a first conveyor portion 112 and a second conveyor portion 132 in line with one another, such that the second conveyor portion 132 is downstream of the first conveyor portion 112. The first conveyor portion 112 has a first end, illustrated as an infeed end 114, and a second end, illustrated as an outfeed end 116. A conveyor belt 118 extends between the infeed end 114 and the outfeed end 116 to convey the stack 90 of sleeve blanks 50 from the infeed end 114 to the outfeed end 116. An optional first guide 120 can also extend along the first conveyor portion 112 to stabilize and align the stack 90 of sleeve blanks 50 moving along the conveyor belt 118. In one non-limiting example, the stack 90 of sleeve blanks 50 is supported on the first conveyor portion 112 with the sleeve blanks 50 in an upright or vertical position to form the stack 90 of upright sleeve blanks 50. In such an example, only the bottom edge 54 of the sleeve blanks 50 contacts the conveyor belt 118, with the stack 90 of sleeve blanks 50 remaining in the upright position as they are conveyed from the infeed end 114 to the outfeed end 116. Further by way of non-limiting example, the first conveyor portion 112 can be substantially horizontal, such that the sleeve blanks 50 in the stack 90 are positioned to extend orthogonally upward from the conveyor belt 118.

The second conveyor portion 132 has a first end, illustrated as an infeed end 134, and a second end, illustrated as an outfeed end 136. The infeed end 134 of the second conveyor portion 132 is located downstream of the outfeed end 116 of the first conveyor portion 112, such as directly after the outfeed end 116 of the first conveyor portion 112, such that the stack 90 of sleeve blanks 50 is conveyed from the outfeed end 116 of the first conveyor portion 112 to the infeed end 134 of the second conveyor portion 132. A conveyor belt 138 extends between the infeed end 134 and the outfeed end 136 to convey the stack 90 of sleeve blanks 50 from the infeed end 134 to the outfeed end 136. An optional second guide 140 can also extend along the second conveyor portion 132 to stabilize and align the stack 90 of sleeve blanks 50 moving along the conveyor belt 138. In one non-limiting example, and as in the first conveyor portion 112, the stack 90 of sleeve blanks 50 is supported on the second conveyor portion 132 with the sleeve blanks 50 in the upright or vertical position to form the stack 90 of upright sleeve blanks 50. In such an example, only the bottom edge 54 of the sleeve blanks 50 contacts the conveyor belt 138, with the stack 90 of sleeve blanks 50 remaining in the upright position as they are conveyed from the infeed end 134 to the outfeed end 136.

Further by way of non-limiting example, the second conveyor portion 132 can be angled upwardly from the infeed end 134 to the outfeed end 136, such that the sleeve blanks 50 in the stack 90 are positioned to extend upward from the conveyor belt 138 at a non-orthogonal angle relative to the conveyor belt 138. By way of non-limiting example, the second conveyor portion 132 can extend upwardly from the infeed end 134 to the outfeed end 136 at an angle of 45 degrees or less relative to the horizontal, further at an angle of 35 degrees or less relative to the horizontal, and further yet at an angle of 25 degrees or less relative to the horizontal.

A first support arm 122 can optionally be provided between the first conveyor portion 112 and the second conveyor portion 132 and configured to aid in properly aligning, positioning, and indexing the stack 90 of sleeve blanks 50 as the sleeve blanks 50 are conveyed from the conveyor belt 118 to the second conveyor belt 138, particularly when the angle between the sleeve blanks 50 and the conveyor belts 118, 138 changes from the first conveyor portion 112 to the second conveyor portion 132. The first support arm 122 can include an upper finger 124 configured to contact, such as to bear against, the top edges 52 of the sleeve blanks 50 for alignment as the stack 90 of sleeve blanks 50 passes from the first conveyor belt 118 to the second conveyor belt 138. The first support arm 122 can further comprise an edge guide 126 spaced from the first guide 120 to contact and align the opposite side edge 24, 26 of the sleeve blanks 50 such that the sleeve blanks 50 can be retained between, such as centered between, the first guide 120 and the edge guide 126 at the infeed end 134 of the second conveyor portion 132.

Together, the first conveyor portion 112 and the second conveyor portion 132 collectively form the infeed assembly 110 to convey and to supply the stack 90 of sleeve blanks 50 to the blank stacker assembly 150 in the appropriate position and alignment to be stacked within the blank stacker assembly 150. The blank stacker assembly 150 is positioned downstream of the infeed assembly 110, such as directly after the outfeed end 136 of the second conveyor portion 132. A second support arm 142 can optionally be provided between the second conveyor portion 132 and the blank stacker assembly 150 and configured to aid in properly aligning, positioning, and indexing the stack 90 of sleeve blanks 50 as the sleeve blanks 50 are conveyed from the conveyor belt 138 to the blank stacker assembly 150, particularly when the angle of the sleeve blanks 50 relative to the horizontal changes from the second conveyor portion 132 to the blank stacker assembly 150, which can be thought of as a stacking or re-stacking of the sleeve blanks 50 within the blank stacker assembly 150. The second support arm 142 can include an upper finger 144 configured to contact, such as to bear against, the top edges 52 of the sleeve blanks 50 for alignment as the stack 90 of sleeve blanks 50 passes from the second conveyor belt 138 to the blank stacker assembly 150.

The blank stacker assembly 150 comprises a frame 152, which supports, and can at least partially define, a magazine, illustrated as a stacker 160, for holding the stack 90 of sleeve blanks 50 to be supplied to the container forming assembly 300. A tamper 154 can optionally be provided with and supported by the frame 152, the tamper 154 positioned to contact, such as to bear against, the top edges 52 of the sleeve blanks 50 for further alignment and indexing as the stack 90 of sleeve blanks 50 passes from the second conveyor belt 138 to the stacker 160. A wheel 156 can further optionally be provided with and supported by the frame 152, the wheel 156 positioned to contact, such as to bear against, the bottom edges 54 of the sleeve blanks 50 as they are provided to be stacked within the stacker 160. The wheel 156 can be selectively driven to rotate to push the bottom edges 54 of the sleeve blanks 50 either forward or backward, as needed, relative to the top edges 52, to properly align and position the stack 90 of sleeve blanks 50 within the stacker 160. For example, if the stack 90 of sleeve blanks 50 is beginning to lean too far forward, the wheel 156 can be operated to help push the bottom edges 54 of the sleeve blanks 50 forward to catch up to the top edges 52 of the sleeve blanks 50 so that the sleeve blanks 50 lay properly within the blank stacker assembly 150.

The stacker 160 defines an infeed end 162 downstream of the outfeed end 136 of the second conveyor portion 132, such as positioned directly after the outfeed end 136 of the second conveyor portion 132, and an outfeed end 164 downstream of the infeed end 162, the stack 90 of sleeve blanks 50 resiliently retained at the outfeed end 164 until removal by the blank carrier 250. The stacker 160 further comprises a set of longitudinal guides 170 extending between the infeed end 162 and the outfeed end 164 to at least partially define the stacker 160 and to retain, guide, and support the stack 90 of sleeve blanks 50 within the stacker 160. In one non-limiting example, the stacker 160, and specifically the longitudinal guides 170, are angled downwardly from the infeed end 162 to the outfeed end 164 to define a downwardly depending stack 90 of sleeve blanks 50 within the stacker 160 that bears downwardly against the outfeed end 164 of the stacker 160, as well as to define a stacker axis that is oriented at a predetermined angle relative to the horizontal. In this way, the force of gravity can aid in forming the stack 90 of sleeve blanks 50 within the stacker 160 as the sleeve blanks 50 pass from the infeed assembly 110 to the blank stacker assembly 150.

By way of non-limiting example, the longitudinal guides 170 can extend downwardly from the infeed end 162 to the outfeed end 164 to define the stacker axis at a predetermined angle of 30 degrees or more relative to the horizontal, further at a predetermined angle of 45 degrees or more relative to the horizontal, and further yet at a predetermined angle of 90 degrees relative to the horizontal. Further by way of non-limiting example, the longitudinal guides 170 can extend downwardly from the infeed end 162 to the outfeed end 164 so as to define a stacker axis to form an angle of 120 degrees or less relative to the second conveyor belt 138, further to form an angle of approximately 90 degrees relative to the second conveyor belt 138, and further yet to form an angle of less than 90 degrees relative to the second conveyor belt 138.

The blank carrier 250 is positioned downstream of the blank stacker assembly 150, such as directly after the outfeed end 164 of the stacker 160, and is configured to selectively remove the sleeve blanks 50 one at a time from the stack 90 of sleeve blanks 50 within the stacker 160 to be provided to the container forming assembly 300. The blank carrier 250 comprises a frame 252 supporting a rotary carrier body 254. The carrier body 254 is rotatable relative to the frame 252 about a longitudinal axis of rotation 256. The blank carrier 250 further comprises at least one suction device 270 configured to selectively contact a lowermost sleeve blank 50 of the stack 90 of sleeve blanks 50 as the carrier body 254 rotates to apply suction to and to remove the sleeve blank 50 from the stack 90 within the stacker 160. In the case that the blank carrier 250 includes more than one suction device 270, sleeve blanks 50 can be carried by more than one of the suction devices 270 at the same time as the carrier body 254 completes a full rotation, but it will be understood that each of the suction devices 270 can remove only a single sleeve blank 50 at one time, such that the sleeve blanks 50 are removed one at a time from the stacker 160 by the suction devices 270.

The sleeve blanks 50 are provided from the stacker 160 to the container forming assembly 300 by the blank carrier 250. The container forming assembly 300 comprises a forming turret 304 having a plurality of forming mandrels 306 and a transfer turret 340. Specifically, the sleeve blanks 50 are carried by the suction devices 270 to be provided to the transfer turret 340, the transfer turret 340 in turn providing the sleeve blanks 50 to the forming turret 304 to be formed into the container 10.

Figure 4:
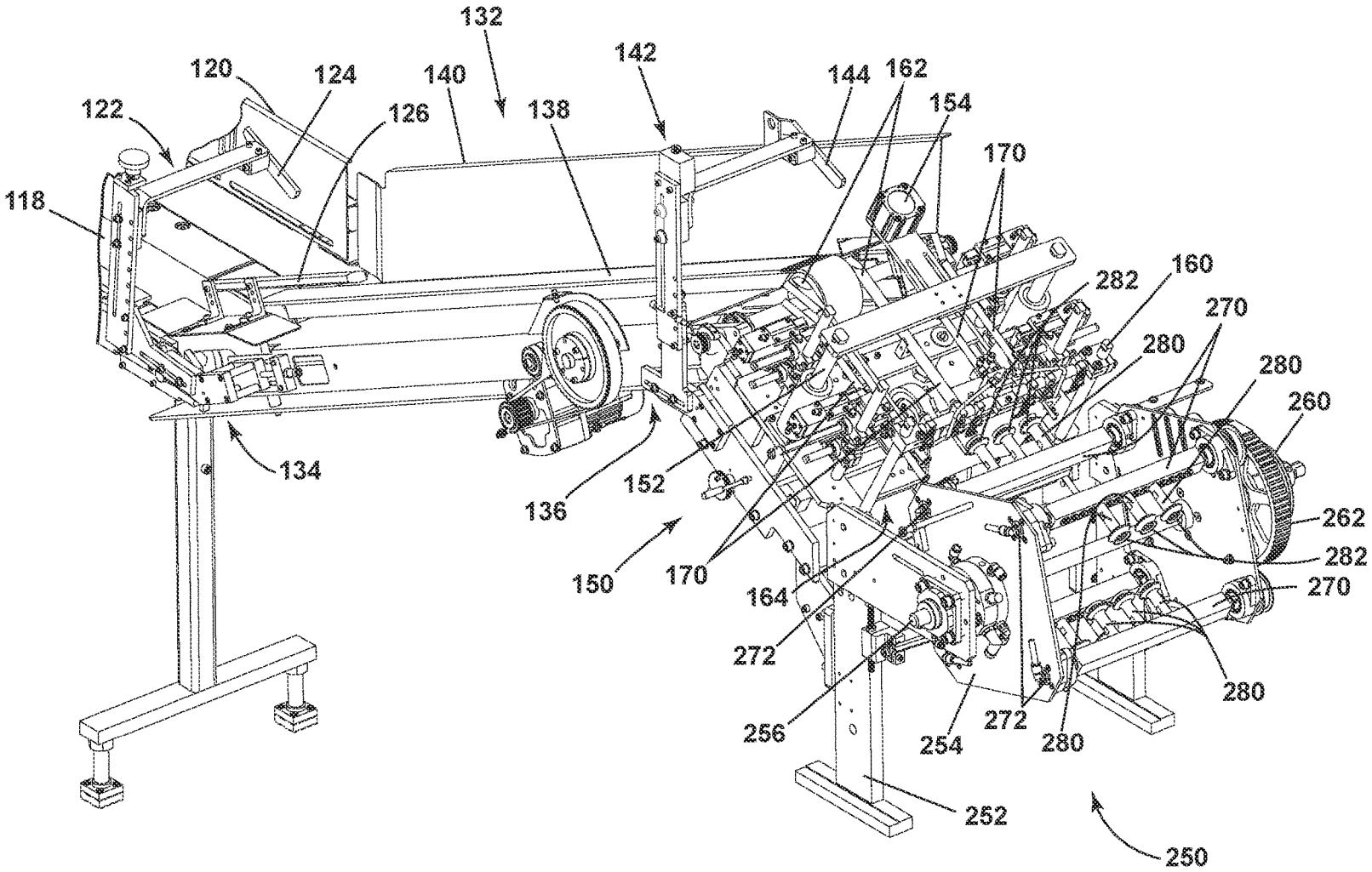
FIG. 4 is an enlarged perspective view of a portion of the container forming machine of FIG. 3, including the blank stacker assembly and the blank carrier.
Figure 9:
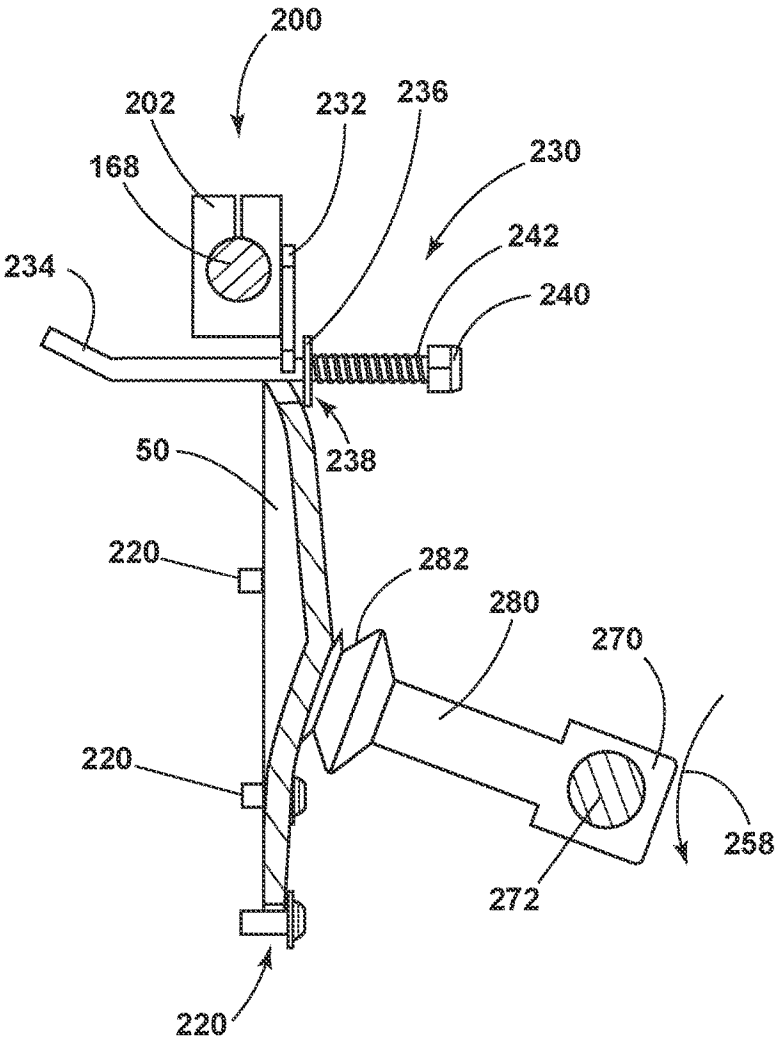
FIG. 9 is the side cross-sectional view of the portion of the stacker of FIG. 8, with the biased blank stop in a release position and the suction device in a removal position.

Referring now to FIG. 4, the details and the structure of the blank stacker assembly 150 and the blank carrier 250 can be better seen. Specifically, the blank carrier 250 further comprises a motor 260 that can be operated to drive rotation of a drive belt 262. The drive belt 262 is operably coupled to the carrier body 254 to rotate the carrier body 254 about the axis of rotation 256 relative to the frame 252. Further, it is shown that the blank carrier 250 includes a plurality of suction devices 270 positioned about a periphery of the carrier body 254. In one non-limiting example, the suction devices 270 are positioned equidistantly from one another about the periphery of the carrier body 254. Each of the suction devices 270 can be rotatable relative to the carrier body 254 about a longitudinal axis of rotation 272 between at least a grasp position (FIG. 8) and a removal position (FIG. 9). Each of the suction devices 270 further comprises a set of suction arms 280, with each of the suction arms 280 extending outwardly from the suction device 270 and terminating in a suction nozzle 282. In one non-limiting example, the suction nozzles 282 comprise suction cups. While each of the suction devices 270 is illustrated herein as having a set of three suction arms 280, it will be understood that any suitable number of suction arms 280 can be provided with each suction device 270, including only a single suction arm 280. The suction devices 270, suction arms 280, and suction nozzles 282 are sized and shape such that the suction nozzles 282 can selectively contact the stack 90 of sleeve blanks 50 as the carrier body 254 is rotated relative to the stacker 160.

Figure 5:
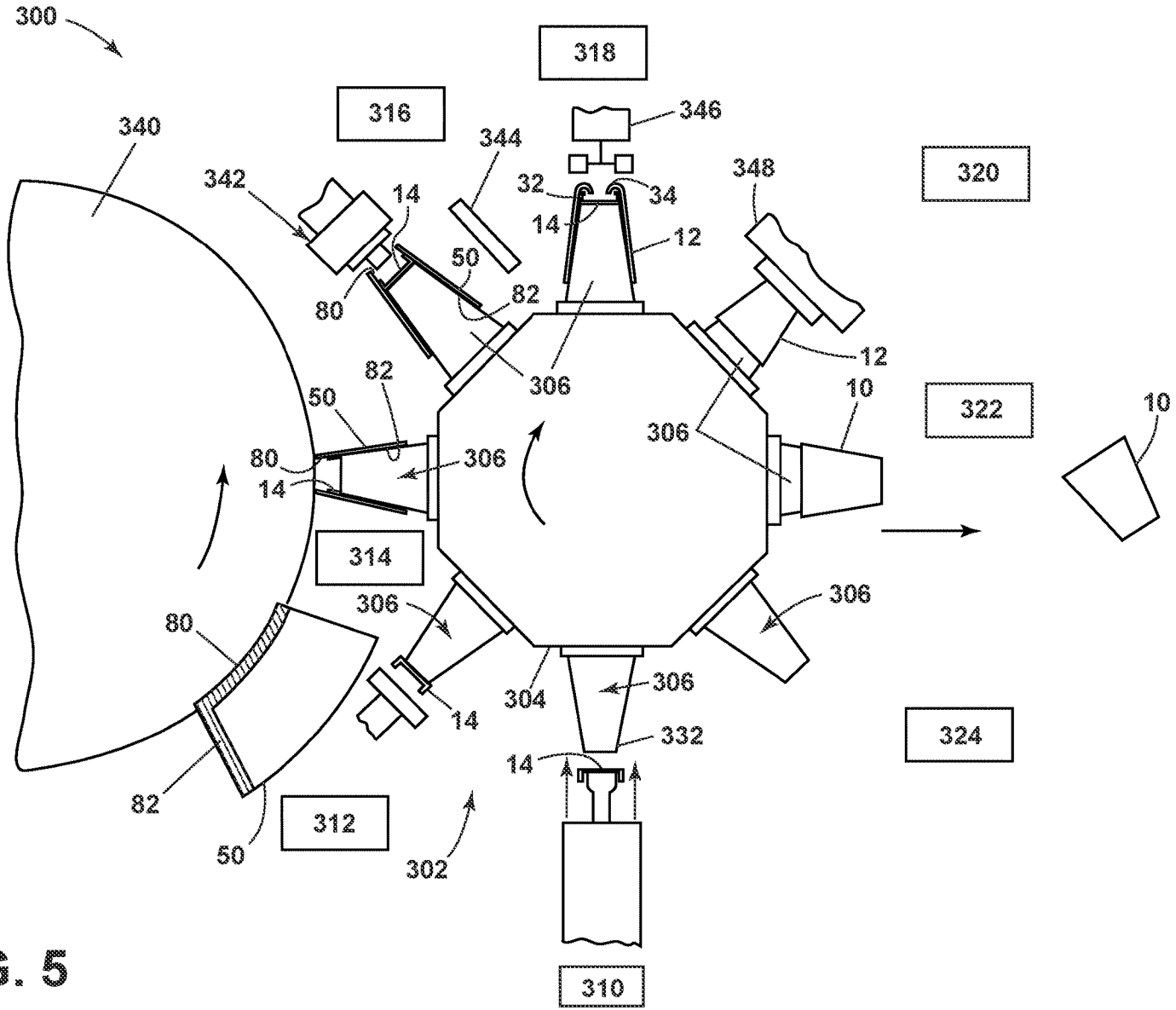
FIG. 5 is a schematic top view of the container forming assembly of FIG. 3, illustrating a process of forming the container of FIG. 1 at the container forming assembly.

Referring now to FIG. 5, the details and the structure of the container forming assembly 300 for forming the container 10 using the sleeve blank 50 provided from the blank stacker assembly 150 can be better seen. The container forming assembly 300 is provided for illustrative purposes and may proceed in a different logical order, or additional or intervening steps may be included, unless otherwise noted. While the container forming assembly 300 is described in the context of forming the container 10, the container forming assembly 300 may be used in a similar manner to form other types of two-piece paper containers.

The container forming assembly 300 can be thought of as comprising a container forming station 302 that includes multiple forming stations 310-324 for assembling the sleeve blank 50 and the bottom blank for forming the container 10. The plurality of forming mandrels 306 of the forming turret 304 can be indexed by the forming turret 304 to each of the forming stations 310-324.

Assembly of the container 10 begins at station 310 with providing the bottom 14 to an end section 332 of the mandrel 306. The supplying of the bottom 14 to the station 310 is independent of the supplying of the stack 90 of sleeve blanks 50 to the container forming assembly 300, and can occur before, after, or concurrently with the supplying of the stack 90 of sleeve blanks 50 to the container forming assembly 300. The bottom 14 can be held in place on the end section 332 by a vacuum. The bottom 14 can be a blank cut and formed from a paperboard web prior to providing the bottom 14 to the container forming station 302. Optionally, the container forming station 302 includes a bottom forming station 312 in which a pre-cut bottom blank is bent to form or re-form the bottom 14 having a bottom wall 30 and the depending skirt 32. Optionally, the container forming station 302 includes a bottom blank cutting station or blank cutter (not shown), in which the bottom blank is cut from a paperboard web prior to the station 310 or the bottom forming station 312.

At station 314, the transfer turret 340 provides the sleeve blank 50 to a wrapping apparatus (not shown) that wraps the sleeve blank 50 around the mandrel 306 and the bottom 14. The sleeve blank 50 is provided to the mandrel 306 with the adhesive bottom flange portion 80 and the adhesive seam portion 82 facing toward the mandrel 306. The wrapping apparatus wraps the sleeve blank 50 around the mandrel 306, including the bottom 14 carried by the mandrel 306, such that the adhesive seam portion 82 overlaps the opposing side edge 24, 26 and the adhesive bottom flange portion 80 overlaps the bottom 14.

At station 316, the adhesive bottom flange portion 80 and the adhesive seam portion 82 can be heated in one or more stages, either simultaneously or sequentially. In the container forming assembly 300 illustrated, a bottom heater 342 is moved into position in the open bottom end of the wrapped sleeve blank 50 to heat the adhesive bottom flange portion 80. A seam clamp 344 can be moved into position relative to the overlapped adhesive seam portion 82 to apply heat and/or pressure to heat-seal the overlapped side edges 24, 26 of the sleeve blank 50 with the adhesive seam portion 82. The seam clamp 344 can provide heat and/or pressure to the adhesive seam portion 82. Optionally, the seam clamp 344 applies only pressure and an optional separate heating device is provided for heating the adhesive seam portion 82. Heating of the adhesive bottom flange portion 80 and the adhesive seam portion 82 can be obtained using any suitable heating device or combination of heating devices, including radiant heat and heated air diffusers. Optionally, the adhesive in the bottom flange and seam portions 80, 82 can be heated while the sleeve blank 50 is on the transfer turret 340, prior to wrapping the sleeve blank 50 onto the mandrel 306 at station 314. Optionally, if heat is not necessary to achieve the desired seal, then only pressure is applied to the seams.

The mandrel 306 is next indexed to station 318 where a bottom curl forming tool 346 is moved into position to fold the flange 34 including the adhesive bottom flange portion 80 around the skirt 32 of the bottom 14. Heat from the bottom heater 342 applied at station 316 can soften the adhesive on the adhesive bottom flange portion 80 to facilitate adhesion of the flange 34 to the skirt 32. At station 320, bottom clamp 348 is utilized to apply pressure to the folded flange 34 to facilitate heat-sealing the adhesive bottom flange portion 80 to the skirt 32 to form the bottom seal 38 between the sleeve 12 and the bottom 14.

The mandrel 306 is then indexed to station 322 where the formed container 10 is ejected. The free mandrel 306 is indexed to station 324 where it is in position to receive the next bottom 14 at station 310. Optionally, the formed container 10 is sent to a waxing station to apply a wax barrier coating to at least the interior of the container 10 to form a waxed paper cup.

According to one aspect, the formed container 10 may be ejected to a rimming station (not shown) that curls or folds the top edge 52 to form the rim 18. The portion of the sidewall seam 22 near the top edge 52 that forms the rim 18 can be stretched during the rimming process, which can decrease the strength of the seal of the sidewall seam 22 in the rim 18 if an adhesive is not used. Providing the adhesive on the seam portion 66 according to the present disclosure addresses these challenges in maintaining the strength of the sidewall seam seal in the area of the rim 18 while allowing the cup forming process to proceed at acceptable rates.

The forming turret 304 rapidly indexes the sleeve blank 50 and the bottom 14 through the various stations 310-324 to form the container 10. A delay or pause at any of the stations 310-324 can result in a decrease in the rate of formation of the container 10. Decreases in the rate of formation decrease the number of containers 10 formed, which can increase production times and costs.

Figure 6:
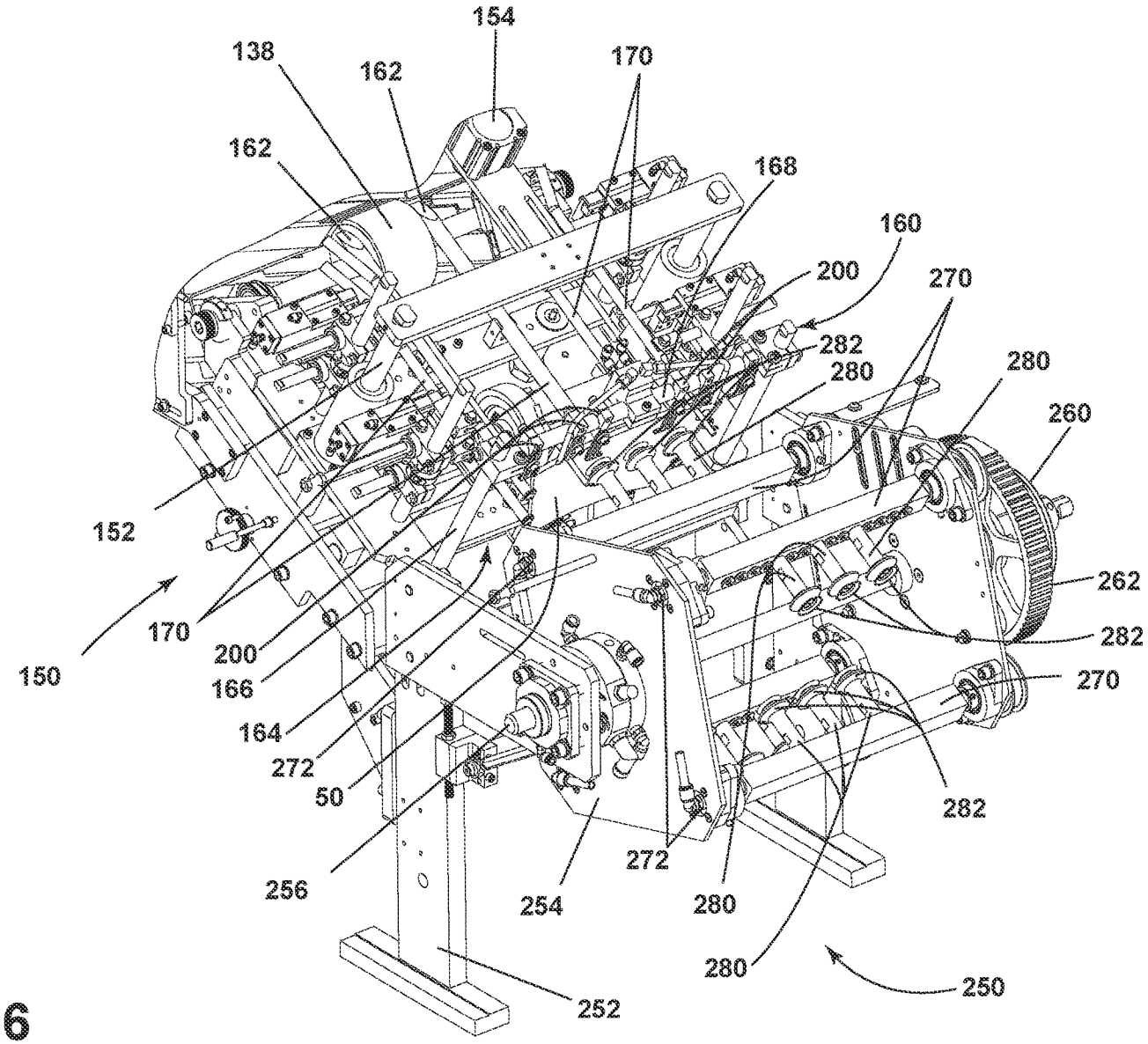
FIG. 6 is an enlarged perspective view of the blank stacker assembly and the blank carrier of FIG. 4, including a stacker for holding a stack of blanks.

Referring now to FIG. 6, the blank stacker assembly 150 is shown with a sleeve blank 50 in position and resiliently retained at the outfeed end 164 of the stacker 160 where the details of the stacker 160 can be better seen. The stacker 160 comprises a pair of opposing supports 166, spaced apart from one another about the set of longitudinal guides 170 and positioned at the outfeed end 164 of the longitudinal guides 170. A mounting bar 168 extends between and is carried by the pair of opposing supports 166 and is positioned above the longitudinal guides 170 and above the stack 90 of sleeve blanks 50. A plurality of blank stops 200 are coupled to and carried by the mounting bar 168.

Figure 7:
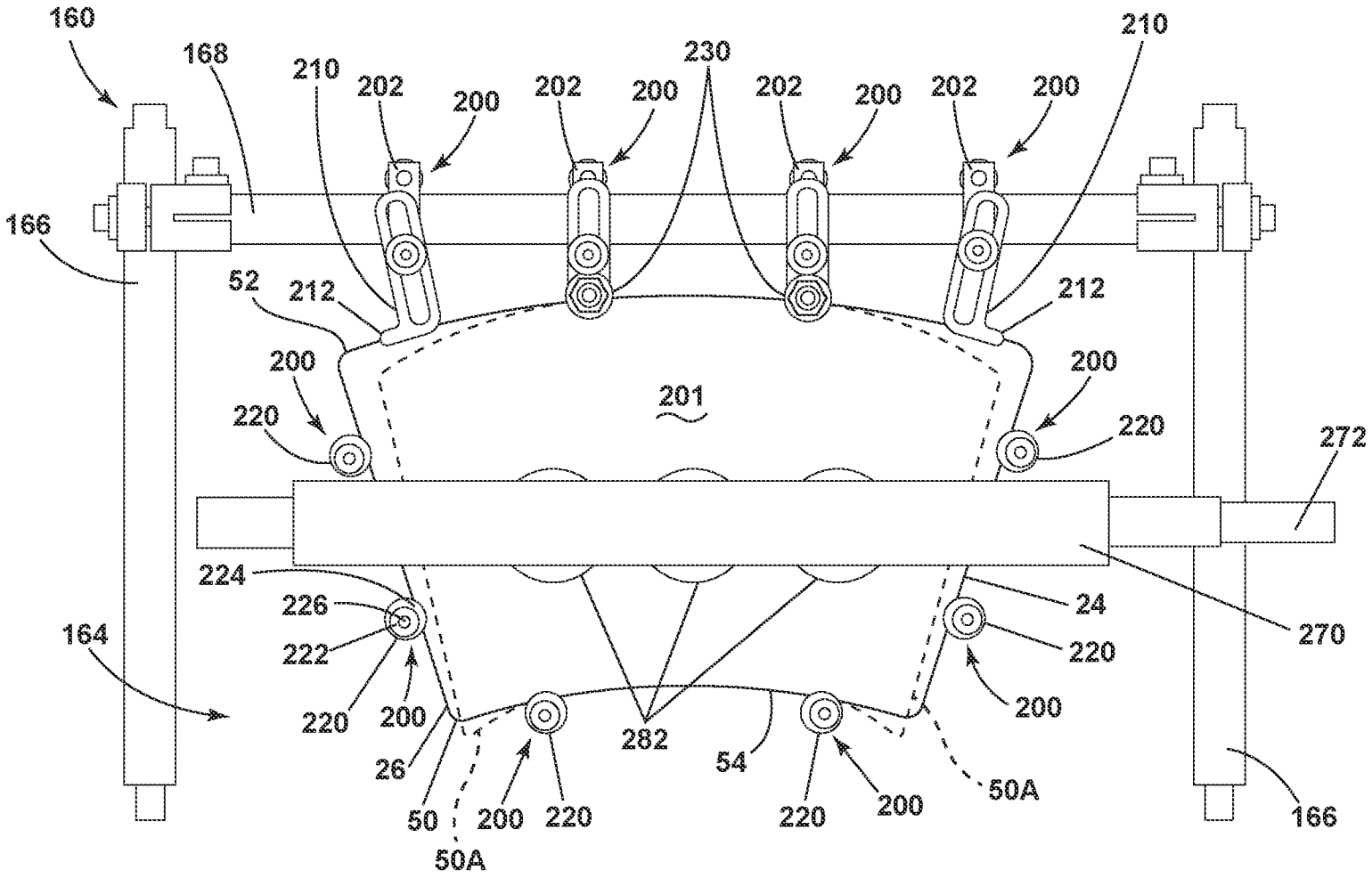
FIG. 7 is a front view of the stacker of FIG. 6, including multiple blank stops holding a bottom blank of the stack of blanks.

The multiple blank stops 200 can be better seen in the front view of FIG. 7 with portions of the blank stacker assembly 150 and of the blank carrier 250 removed to best show the positioning of the stack 90 of sleeve blanks 50 relative to the stacker 160, as well as of the position of the suction device 270 relative to the stack 90 of sleeve blanks 50 and to the stacker 160. The stacker 160 comprises the multiple blank stops 200 carried by or mounted to the mounting bar 168, as well as multiple additional blank stops 200 each coupled to and carried by the outfeed end 164 of the longitudinal guides 170. Collectively, the blank stops 200 carried by the mounting bar 168 and the blank stops 200 carried by the longitudinal guides 170 are configured to resiliently retain the stack 90 of sleeve blanks 50 at the outfeed end 164 of the stacker 160. Specifically, the multiple blank stops 200 resiliently retain the stack 90 of sleeve blanks 50 by contacting and directly resiliently retaining the lowermost sleeve blank 50 of the stack 90 at the outfeed end 164 of the stacker 160.

The multiple blank stops 200 are further arranged about the sleeve blank 50 to hold the peripheral edges 24, 26, 52, 54 of the sleeve blank 50 of the bottom sleeve blank 50 of the stack 90, with the multiple blank stops 200 further yet defining an interior region 201 positioned within the periphery of the multiple blank stops 200, and within which the sleeve blank 50 is not contacted by the multiple blank stops 200. In one non-limiting example, when the suction device 270 is positioned to selectively contact the sleeve blank 50, the suction nozzles 282 can contact the sleeve blank 50 within the interior region 201 exposed between the blank stops 200. Further by way of non-limiting example, the interior region 201 can at least partially correspond to and overlap with the cavity portion 60 of the sleeve blank 50.

The multiple blank stops 200 can further comprise more than one type of blank stop 200. In one example, the blank stops 200 provided on the outfeed ends 164 of the longitudinal guides 170 can be provided as non-biased blank stops, illustrated as fixed blank stops 220. As the sleeve blanks 50 are retained within the longitudinal guides 170, the diameter or cross-sectional area of the longitudinal guides 170 does not protrude inwardly of the peripheral edges 24, 26, 54 of the sleeve blank 50. A fastener 226, such as a bolt or a screw, having a head 222 can be coupled to the outfeed ends 164 of each of the longitudinal guides 170, with still neither the fastener 226 nor the head 222 extending beyond the cross-sectional profile of the longitudinal guides 170 to extend inwardly of the peripheral edges 24, 26, 54 of the sleeve blank 50. Instead, each fastener 226 retains a finger, illustrated as a washer 224, between the head 222 and the outfeed end 164 of the longitudinal guide 170, with the washer 224 having at least a portion that protrudes beyond the cross-sectional profile of the longitudinal guide 170 to extend inwardly of the peripheral edges 24, 26, 54 of the sleeve blank 50 to bear against and to retain the sleeve blank 50.

The multiple blank stops 200 that are carried by the mounting bar 168 each comprise a coupling element 202 that mounts the blank stops 200 about the mounting bar 168. In one example, the coupling elements 202 movably mount the blank stops 200 to the mounting bar 168, such that the coupling elements 202 are laterally movable, such as by being slidable, along the longitudinal length of the mounting bar 168, such that the coupling elements 202 are rotatably movable relative to the mounting bar 168 for adjustability of the angle of the blank stops 200 relative to the sleeve blank 50, or both. Rotatable movement of the coupling elements 202 relative to the mounting bar 168 allows for adjustability of the retaining pressure that is needed or desired to be applied to the stack 90 of the sleeve blanks 50.

While at least some of, or even all of, the blank stops 200 carried by the mounting bar 168 include the coupling element 202, the multiple blank stops 200 carried by the mounting bar 168 can still comprise more than one type of blank stop 200. In one example, at least one of the blank stops 200 carried by the mounting bar 168 can be provided as a non-biased blank stop 210. The non-biased blank stop 210 can include a finger, illustrated as a flange 212, extending radially from the non-biased blank stop 210 along the top edge 52 of the sleeve blank 50. At least a portion of the non-biased blank stop 210, including at least a portion of the flange 212, extends inwardly of the top edge 52 of the sleeve blank 50 to bear against and to retain the top edge 52 of the sleeve blank 50. The non-biased blank stop 210 can be movable relative to the coupling element 202 so as to be adjustable to accommodate sleeve blanks 50 having varying sizes or shapes of top edges 52, such as by vertical and rotational movement relative to the coupling element 202.

Additionally, or alternatively, at least one of the blank stops 200 carried by the mounting bar 168 can be provided as a biased blank stop 230. At least a portion of the biased blank stop 230 extends inwardly of the top edge 52 of the sleeve blank 50 to bear against and to retain the top edge 52 of the sleeve blank 50. Further, the biased blank stop 230 is movable relative to the sleeve blank 50 between at least a retaining position (FIG. 8) and a release position (FIG. 9) to selectively apply a biasing force to a portion of the top edge 52 of the bottom sleeve blank 50. The biased blank stop 230 can be movable relative to the coupling element 202 so as to be adjustable to accommodate sleeve blanks 50 having varying sizes or shapes of top edges 52, such as by vertical and rotational movement relative to the coupling element 202.

The types of blank stops 200 included with the stacker 160, as well as the number and relative positions of the various types of blank stops 200, can be specifically designed or selected from available blank stops 200 in order to both resiliently retain, as well as to selectively release, the sleeve blanks 50, such as for both flat sleeve blanks 50 and for sleeve blanks 50 that may have a curl due to rolling of the paperboard web 51. One example of such a curled sleeve blank 50A is shown in dashed outline. The curled sleeve blank 50A is illustrated as being curled in a lateral or side-to-side direction, such that the side edges 24, 26 curl inwardly toward one another and toward the center of the curled sleeve blank 50A, though it will be understood that the sleeve blanks 50 can be curled in other directions, as well. In order to accommodate both flat sleeve blanks 50 and curved sleeve blanks 50A, the type, number, relative positions, and strength of the blank stops 200 included with the stacker 160 are selected or provided such that the blank stops 200 can resiliently retain both flat sleeve blanks 50 and curved sleeve blanks 50A to prevent unintentional release of sleeve blanks 50 from the blank stops 200, while also ensuring that both flat sleeve blanks 50 and curved sleeve blanks 50A are successfully selectively released, and released only one at a time, from the blank stops 200 when withdrawn by the suction device 270.

In the illustrated example, pairs of non-biased fixed blank stops 220 are provided along each of the side edges 24, 26 and the bottom edge 54, while both non-biased blank stops 210 and biased blank stops 230 are provided along the same one edge 24, 26, 52, 54, specifically the top edge 52. Specifically, at least one biased blank stop 230 is located between a pair of outermost, spaced apart non-biased blank stops 210 along the top edge 52 of the sleeve blank 50, with the illustrated example including a pair of biased blank stops 230 located between the pair of outermost, spaced apart non-biased blank stops 210 along the one edge 24, 26, 52, 54, specifically the top edge 52. Further, the pair of biased blank stops 230 positioned between the pair of outermost non-biased blank stops 210 can be spaced from one another about the center or midpoint of the sleeve blank 50. However, it will be understood that the illustrated arrangement of the blank stops 200 is not limiting, and that any suitable number of blank stops 200, and any suitable number of each type of blank stop 200, can be provided in any suitable relative arrangement.

Regardless of the type of the blank stops 200, the extent or distance to which the various blank stops 200 extend inwardly from the peripheral edges 24, 26, 52, 54 of the sleeve blank 50 to retain the sleeve blank 50 can be determined based on the size and shape of the sleeve blank 50, as well as the desired retaining force to be applied by the blank stops 200. Further, this distance can be the same for all types of the blank stops 200, or it can differ between some or all of the types of blank stops 200. Further regardless of the type of the blank stops 200, an air injector (not shown) can be provided and positioned adjacent the bottom sleeve blank 50 of the stack 90, and thus also adjacent the outfeed end 164 of the stacker 160, that can be configured to provide an air flow, such as an air jet, to aid in urging the removal of the bottom sleeve blank 50 from the stack 90 when the sleeve blank 50 is removed by the blank carrier 250.

Figure 8:
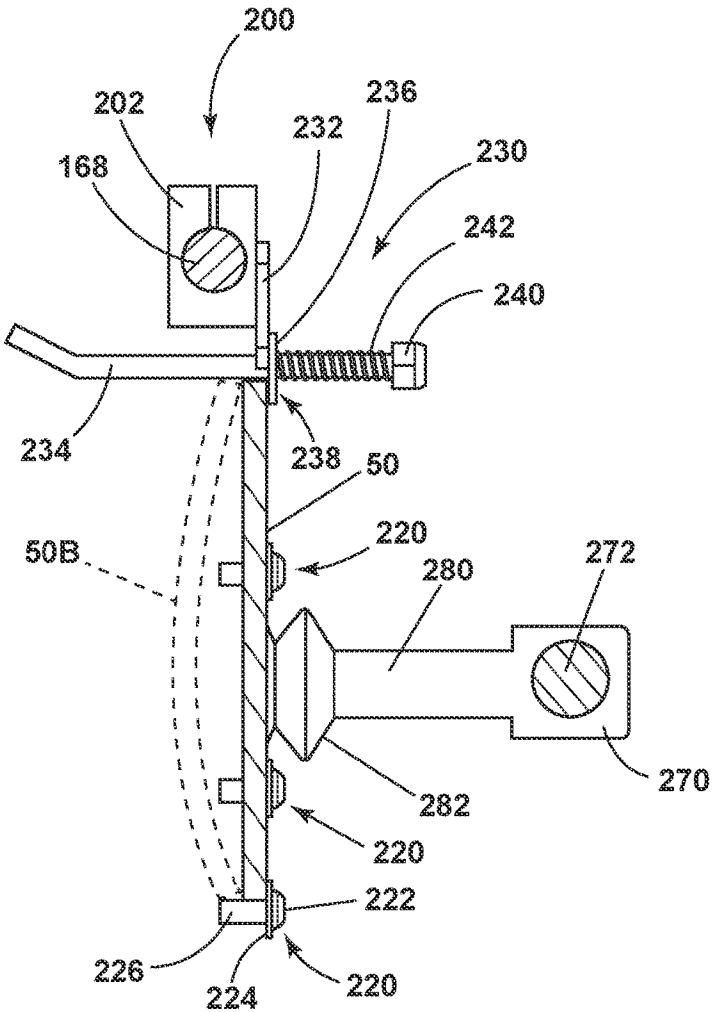
FIG. 8 is a side cross-sectional view of a portion of the stacker of FIG. 7, including a biased blank stop in a retaining position and a suction device in a grasp position.

FIGS. 8-9 illustrate the at least one biased blank stop 230 in greater detail, as well as the removal of the sleeve blank 50 from the at least one biased blank stop 230. It will be noted that the sleeve blank 50 as illustrated can be any of the flat sleeve blank 50, the curled sleeve blank 50A of FIG. 7, or, as illustrated in FIG. 8, another example of a curled sleeve blank 50B that is shown in dashed outline. The curled sleeve blank 50B is illustrated as being curled in a vertical, top-to-bottom, and/or bottom-to-top direction, such that the top edge 52 and the bottom edge 54 curl downwardly and upwardly, respectively, toward one another and toward the center of the curled sleeve blank 50B, though it will be understood that such a direction of curling is non-limiting. Regardless of any curling of the sleeve blank 50, 50A, 50B, the function and operation of the at least one biased blank stop 230 occurs in the same way, as described in more detail below.

Referring now to FIG. 8, the biased blank stop 230 is shown in the retaining position, while the suction device 270 is shown in the grasp position relative to the sleeve blank 50.

The biased blank stop 230 comprises an adjustable coupler 232 that couples the biased blank stop 230 to the coupling element 202. The adjustable coupler 232 is movable relative to the coupling element 202 to allow the biased blank stop 230 to be adjustable to accommodate sleeve blanks 50 having varying sizes or shapes of top edges 52, such as for vertical movement in up and down directions and for rotational movement relative to the coupling element 202. The adjustable coupler 232 is also fixedly coupled to and carries a shaft 234 that extends outwardly in forward and backward directions from the adjustable coupler 232. The shaft 234 can also serve to abut and retain the sleeve blank 50, such that the diameter or cross-sectional profile of the shaft 234 does not protrude inwardly of the top edge 52 of the sleeve blank 50.

The biased blank stop 230 further comprises a finger, illustrated as a washer 236 provided about the shaft 234, forwardly of the adjustable coupler 232, and moveable along the shaft 234 forward of the adjustable coupler 232. The washer 236 comprises at least a portion, illustrated as a finger portion 238, that protrudes beyond the cross-sectional profile of the shaft 234 to extend inwardly of the top edge 52 of the sleeve blank 50 to selectively bear against and retain the top edge 52 of the sleeve blank 50. A nut 240 is threaded onto the shaft 234 at a forwardmost end of the shaft 234. A spring 242 is wound about the shaft 234 and located between the washer 236 and the nut 240. The length and force of the spring 242 can be provided such that the spring 242 will abut the nut 240 and the washer 236, including at least a portion of the finger portion 238 of the washer 236, and further such that the spring 242 applies a biasing force against the washer 236 toward the sleeve blank 50, causing the washer 236 to act as a biased element in applying the biasing force from the spring 242 to a portion of the top edge 52 of the sleeve blank 50. When the biased blank stop 230 is in the retaining position as shown, the washer 236 contacts the sleeve blank 50, thus allowing the washer 236 to apply the biasing force against the sleeve blank 50. The biasing of the washer 236 against the top edge 52 of the sleeve blank 50 serves to further resiliently retain the sleeve blank 50 within the stacker 160.

One suction device 270 is shown in the grasp position relative to the sleeve blank 50, as well as relative to the carrier body 254 and the rotational position of the carrier body 254 relative to the frame 252, with other portions of the blank carrier 250 removed for clarity. In the grasp position of the suction device 270, the at least one suction nozzle 282 contacts the sleeve blank 50 to apply a suction force to the sleeve blank 50. Specifically, the at least one suction nozzle 282 contacts the sleeve blank 50 within the interior region 201 between the blank stops 200. The suction device 270 reaches this grasp position when the carrier body 254 is rotated to a corresponding position relative to the frame 252, as well as when the suction device 270 is rotated to the appropriate position relative to the carrier body 254.

Referring now to FIG. 9, the biased blank stop 230 is shown in the release position, while the suction device 270 is shown in the removal position relative to the sleeve blank 50. In the release position of the biased blank stop 230, the washer 236, acting as the biased element as previously described, is moved against the biasing force applied by the spring 242. As a result, the washer 236 is moved away from the adjustable coupler 232 and toward the nut 240. This movement of the washer 236 in turn compresses the spring 242 between the washer 236 and the nut 240.

In the removal position of the suction device 270, as the carrier body 254 of the blank carrier 250 continues its rotation in the direction of the arrow 258, the suction device 270 is drawn downwardly, away from the top edge 52, relative to the sleeve blank 50, resulting in rotation of the suction nozzle 282 upwardly relative to the suction device 270 about the axis of rotation 272. The suction force applied to the sleeve blank 50 via the suction nozzle 282 in turn pulls the sleeve blank 50 toward the suction device 270, as well as downwardly and outwardly relative to the biased blank stop 230.

Turning now to the operation of the biased blank stop 230 and the suction device 270, when the suction device 270 is in the grasp position relative to the sleeve blank 50, as in FIG. 8, the suction force is applied to the sleeve blank 50. Continued rotation of the carrier body 254 as shown by the arrow 258 draws the suction device 270 downwardly and away from the top edge 52 and the biased blank stop 230. Initially, the suction force applied by the suction nozzle 282 to the sleeve blank 50 causes the suction nozzle 282 to stay in place against the sleeve blank 50, resulting in upward rotation of the suction nozzle 282 relative to the suction device 270 about the axis of rotation 272. However, when the suction device 270 is moved sufficiently downward that the suction nozzle 282 can no longer be rotated further to remain in the grasp position relative to the sleeve blank 50, the suction force applied by the suction nozzle 282 to the sleeve blank 50 as the suction device 270 is pulled downwardly and away from the sleeve blank 50 overcomes the retaining force of the biased blank stop 230, as well as of the other blank stops 200, and begins to pull the sleeve blank 50 away from the stack 90.

As the suction device 270 moves from the grasp position to the removal position of FIG. 9, the sleeve blank 50 is pulled downwardly and outwardly away from the biased blank stop 230 and begins to be withdrawn from the blank stops 200. When the sleeve blank 50 is moved thusly in response to the suction device 270 moving from the grasp position to the removal position, the sleeve blank 50 moves the washer 236 against the biasing force of the spring 242, away from the adjustable coupler 232, and toward the release position. When the bottom sleeve blank 50 has been pulled to the extent that the sleeve blank 50 is released from contact with the blank stops 200, the sleeve blank 50 is then pulled through the interior region 201 to be completely removed from the stacker 160 and from the stack 90 of sleeve blanks 50. The sleeve blank 50 can then be provided to the transfer turret 340 and to the container forming assembly 300 as previously described.

When the sleeve blank 50 to be removed by the suction device 270 is the side-to-side curled sleeve blank 50A, as in FIG. 7, it is shown that the inward curling of the side edges 24, 26 can result in the side edges 24, 26 not being caught by the blank stops 200, and more specifically such that the side edges 24, 26 are curled forward and are thus not retained by the non-biased fixed blank stops 220. In such an example, with the curled sleeve blank 50A then being retained by fewer of the blank stops 200 relative to the flat sleeve blank 50, the downward pressure of the stack 90 pressing the curled sleeve blank 50A against the blank stops 200 is distributed over fewer blank stops 200. This results in increased pressure being applied by the curled sleeve blank 50A against the centermost blank stops 200 that are still retaining the curled sleeve blank 50A, as compared to the pressure that is applied by the flat sleeve blank 50 against the centermost blank stops 200, which is relatively less due to the pressure being distributed more evenly against all of the blank stops 200 along all of the peripheral edges 24, 26, 52, 54.

In another example, when the sleeve blank 50 to be removed by the suction device 270 is the vertically curled sleeve blank 50B, as in FIG. 8, it is shown that the curling of the top edge 52 and the bottom edge 54 causes the vertically curled sleeve blank 50B to bear disproportionately against the blank stops 200 retaining the top edge 52 and the bottom edge 54. When the vertically curled sleeve blank 50B reaches the bottom of the stack 90 to bear against the blank stops 200, the vertically curled sleeve blank 50B is pushed against the blank stops 200 by the stack 90 behind it so as to assume a flat position against the blank stops 200, in which the vertically curled sleeve blank 50B is retained by all of the available blank stops 200, just as the flat sleeve blank 50 would be, and unlike the exemplary side-to-side curled sleeve blank 50A. However, despite the vertically curled sleeve blank 50B appearing flat against the blank stops 200, the forwardly curled top edge 52 and bottom edge 54 still apply increased pressure against the blank stops 200 retaining the top edge 52 and the bottom edge 54, as compared to the pressure that is applied by the flat sleeve blank 50 evenly along all of the peripheral edges 24, 26, 52, 54.

Thus, despite having different curling profiles, both the side-to-side curled sleeve blank 50A and the vertically curled sleeve blank 50B, when positioned against and retained by the blank stops 200, result in increased pressure being applied against the centrally positioned blank stops 200, illustrated in the present examples as the biased blank stops 230 along the top edge 52 and the non-biased fixed blank stops 220 along the bottom edge 54. In a stacker 160 that does not include such biased blank stops 230, the increased pressure against the centrally positioned blank stops 200 can result in the curled sleeve blanks 50A, 50B being retained too strongly by the blank stops 200, such that the curled sleeve blanks 50A, 50B are prevented from being successfully removed by the suction device 270, due to the suction force applied to the curled sleeve blanks 50A, 50B by the suction nozzles 282 being insufficient to withdraw the curled sleeve blanks 50A, 50B from the blank stops 200. Alternatively, or additionally, the increased pressure against the centrally positioned blank stops 200 when the stacker 160 does not include biased blank stops 230 can result in the unintentional release of more than one curled sleeve blank 50A, 50B at a time when the suction device 270 is operated, rather than withdrawing only one sleeve blank 50 from the blank stops 200 as would occur in normal operation.

By including the biased blank stops 230, and specifically in the positions and orientations as illustrated, such inefficiencies can be avoided. The strength of the biased blank stops 230, such as of the spring 242, can be specifically provided or selected to accommodate the increased central pressure applied by the curled sleeve blanks 50A, 50B. First, the ability of the biased blank stop 230 to be moved from the retaining position to the release position allows the curled sleeve blanks 50A, 50B to be more easily withdrawn from the biased blank stops 230 when removed by the suction device 270, as compared to a stacker 160 that did not include the biased blank stops 230 along the top edge 52 and may instead have only non-biased blank stops 210, 220 that can hold the curled sleeve blanks 50A, 50B too tightly and prevent the curled sleeve blanks 50A, 50B from being removed by the suction device 270. Second, the biasing of the washer 236 against the top edge 52 by the spring 242 allows the biased blank stop 230 to quickly snap back or be biased back into the retaining position after the removal of one sleeve blank 50, 50A, 50B, preventing the issue of multiple sleeve blanks 50, 50A, 50B being removed at once that can occur when only non-biased blank stops 210, 220 are included with the stacker 160.

In these ways, the inclusion of the biased blank stops 230, as well as their specific positioning relative to the sleeve blank 50, 50A, 50B, their specific positioning relative to the non-biased blank stops 210, 220, and the biasing force of the spring 242, allow for the stacker 160 to better accommodate a wide variety of sleeve blanks 50, including curled sleeve blanks 50A, 50B that can be curled in a variety of directions, while still operating as intended to resiliently retain the sleeve blanks 50, 50A, 50B when appropriate and to selectively release the sleeve blanks 50, 50A, 50B when withdrawn by the suction device 270, and specifically to selectively release the sleeve blanks 50, 50A, 50B one at a time to the suction device 270. By reducing or eliminating those feed issues or errors that can occur with only non-biased blank stops 210, 220 being included, the efficiency of operation of the container forming machine 100 is improved as compared to using stackers 160 not including biased blank stops 230, resulting in less waste of materials to unintentionally released sleeve blanks 50, 50A, 50B, higher cup-forming rates, decreased need for intervention by an operator to adjust the blank stops 200, and reduced costs of manufacturing.

The aspects described in the present disclosure set forth a container forming machine for forming a paperboard container including a paperboard blank stacker assembly with multiple blank stops provided for effective resilient retention of a stack of sleeve blanks within a stacker, as well as for selective release of sleeve blanks from the stack and from the stacker. The number, type, arrangement, and relative positioning of various blank stops serves to effectively retain the stack of sleeve blanks and to prevent unintentional release of blanks from the bottom of the stack due to gravitational force, while also allowing for smooth and efficient release of blanks from the bottom of the stack due to the application of suction force by a suction device of a blank carrier. Specifically, the inclusion and arrangement of both non-biased blank stops and biased blank stops can optimize the performance of the stacker to perform ideally with both flat blanks, as well as with blanks that may have some curling due to rolling of the paperboard web prior to blanking. By being able to accommodate both flat blanks and curled blanks without issues or delays, undesirable delays in production are avoided. With the stacker and blank stop assembly of the present disclosure, container forming rates of even 130 cups per minute (cpm) can be maintained, even with a mix of flat and curled blanks provided to the stacker.

Further, the positioning of the biased blank stops at a center point of the top edge of the blank specifically counteracts the tendency of the center of the blank to tip forward or bow forward slightly due to the most pressure being applied at the center of the magazine stack, as well as the tendency for the biggest arc or curl of the blank to be seen at the center of the blank. Further yet, even when curled blanks are not present to provide a challenge within the container forming machine, the humidity in the environment of the container forming machine can vary throughout a calendar year with the changing of the seasons and can cause variations in the rigidity of the paperboard blanks, even if they were not cut from a paperboard web stored in a roll. The inclusion of the biased blank stops can also help in the same way to improve performance of the blank stacker assembly and thus to absorb this variation in rigidity of the blanks due to changes in the environmental weather and humidity.

It will also be understood that various changes and/or modifications can be made without departing from the spirit of the present disclosure. By way of non-limiting example, although the present disclosure is described for use with the formation of paperboard cups, it will be recognized that the methods and apparatus as described in the present disclosure can be employed with various types of containers to be formed, as well as with other types of blanks then sleeve blanks, or with blanks formed of materials other than paperboard, such as foams, plastics, or mixtures thereof.

To the extent not already described, the different features and structures of the various aspects can be used in combination with each other as desired. That one feature is not illustrated in all of the aspects is not meant to be construed that it cannot be, but is done for brevity of description. Thus, the various features of the different aspects can be mixed and matched as desired to form new aspects, whether or not the new aspects are expressly described. Combinations or permutations of features described in the present disclosure are also covered by this disclosure.

This written description uses examples to disclose aspects of the disclosure, including the best mode, and also to enable any person skilled in the art to practice aspects of the disclosure, including making and using any devices or systems and performing any incorporated methods. While aspects of the disclosure have been specifically described in connection with certain specific details thereof, it is to be understood that this is by way of illustration and not of limitation. Reasonable variation and modification are possible within the scope of the forgoing disclosure and drawings without departing from the spirit of the disclosure, which is defined in the appended claims.

What is claimed is:

1. A paperboard blank stacker assembly for supplying a stack of paperboard blanks to a container forming machine, the assembly comprising:

a stacker defining a stacker axis oriented at a predetermined oblique angle to the horizontal and having multiple blank stops arranged to hold a peripheral edge of a bottom blank of the stack of paperboard blanks, with the multiple blank stops defining an interior region, such that, when the stack of paperboard blanks is within the stacker, the stack of paperboard blanks depends downwardly against the multiple blank stops; and a blank carrier having at least one suction device moveable into a grasp position, where the suction device applies a suction force to the bottom blank, and a removal position, where the suction device is moved to remove the bottom blank from the stack of paperboard blanks by pulling the bottom blank through the interior region;

wherein at least one of the blank stops comprises a biased blank stop having a biased element applying a biasing force to a portion of the peripheral edge of the bottom blank, and the biased element is moved against the biasing force when the bottom blank is moved in response to the suction device moving from the grasp position to the removal position.

2. The assembly of claim 1 wherein the multiple blank stops further comprise non-biased blank stops.

3. The assembly of claim 2 wherein the biased blank stop is located along a top edge of the bottom blank and the non-biased blank stops are located along at least one other edge of the bottom blank.

4. The assembly of claim 2 wherein the biased blank stop is located between non-biased blank stops.

5. The assembly of claim 4 wherein the multiple blank stops located along one edge of the bottom blank comprise two outermost non-biased blank stops, with the at least one biased blank stop located between the two outermost non-biased blank stops.

6. The assembly of claim 5 wherein the one edge of the bottom blank comprises a top edge of the bottom blank.

7. The assembly of claim 5 wherein the at least one biased blank stop located between the two outermost non-biased blank stops comprises a pair of biased blank stops, with the pair of biased blank stops located between the two outermost non-biased blank stops.

8. The assembly of claim 7 wherein the one edge of the bottom blank comprises a top edge of the bottom blank.

9. The assembly of claim 8 wherein the pair of biased blank stops are spaced from one another about a center of the top edge of the bottom blank.

10. The assembly of claim 1 wherein the biased blank stop is located along a top edge of the bottom blank.

11. The assembly of claim 10 wherein the biased blank stop is located near a center of the top edge of the bottom blank.

12. The assembly of claim 1 wherein the predetermined oblique angle is 30 degrees or more.

13. The assembly of claim 1 wherein the stacker further comprises a mounting bar carrying at least one of the multiple blank stops, and wherein the biased blank stop is at least one of slidable or rotatable relative to the mounting bar of the stacker.

14. The assembly of claim 13 wherein the multiple blank stops further comprise non-biased blank stops, wherein at least one of the non-biased blank stops is at least one of slidable or rotatable relative to the mounting bar of the stacker.

15. The assembly of claim 14 wherein the biased blank stop and the non-biased blank stops each comprise a finger, with the finger of the biased blank stop having a different shape from the fingers of the non-biased blank stops.

16. The assembly of claim 1 wherein the suction device comprises at least one suction cup.

17. The assembly of claim 1 wherein the biased element comprises a finger and a spring abutting the finger.

18. The assembly of claim 17 wherein the finger comprises a washer moveable along a shaft and the spring is wound about the shaft.

19. The assembly of claim 18 further comprising a nut threaded onto the shaft, with the spring located between the washer and the nut.

* * * * *